US008162468B2

(12) United States Patent
Kulpa et al.

(10) Patent No.: US 8,162,468 B2
(45) Date of Patent: Apr. 24, 2012

(54) SYSTEM AND METHOD FOR REGISTERING COLOR INK JET PRINTING IN A MAILING MACHINE

(75) Inventors: Walter J. Kulpa, Trumbull, CT (US); Jay Reichelsheimer, Shelton, CT (US)

(73) Assignee: Pitney Bowes Inc., Stamford, CT (US)

( * ) Notice: Subject to any disclaimer, the term of this patent is extended or adjusted under 35 U.S.C. 154(b) by 603 days.

(21) Appl. No.: 12/334,841

(22) Filed: Dec. 15, 2008

(65) Prior Publication Data

US 2010/0149295 A1 Jun. 17, 2010

(51) Int. Cl.
*B41J 2/01* (2006.01)
*B41J 29/38* (2006.01)

(52) U.S. Cl. ..... 347/102; 347/17; 347/104

(58) Field of Classification Search ..... 347/17, 347/101, 102, 104
See application file for complete search history.

(56) References Cited

U.S. PATENT DOCUMENTS

| | | | | |
|---|---|---|---|---|
| 5,806,994 | A | 9/1998 | Coffy et al. | |
| 5,889,535 | A | 3/1999 | Jackson et al. | |
| 5,969,735 | A | 10/1999 | Haigo | |
| 6,276,770 | B1 | 8/2001 | Muller et al. | |
| 6,431,778 | B1 | 8/2002 | Coudray et al. | |
| 6,517,269 | B1 | 2/2003 | Scholz et al. | |
| 6,550,994 | B2 | 4/2003 | Manduley | |
| 6,561,612 | B2 | 5/2003 | Minckler | |
| 6,612,676 | B1 | 9/2003 | Minckler | |
| 6,685,184 | B2 | 2/2004 | Tufecki et al. | |
| 6,752,079 | B2 | 6/2004 | Collins et al. | |
| 6,783,227 | B2 * | 8/2004 | Suzuki et al. | 347/102 |
| 6,792,332 | B1 | 9/2004 | DePoi | |
| 6,866,434 | B2 | 3/2005 | Schuppan | |
| 6,962,401 | B2 | 11/2005 | Thiessen et al. | |
| 6,966,711 | B2 | 11/2005 | Miller et al. | |
| 7,004,464 | B2 | 2/2006 | Hattori et al. | |
| 7,163,348 | B2 | 1/2007 | Kulpa et al. | |
| 7,168,700 | B2 | 1/2007 | Skadow et al. | |
| 7,182,428 | B2 | 2/2007 | Le Gallo | |
| 7,255,422 | B2 | 8/2007 | Haug | |
| 7,431,419 | B2 | 10/2008 | Turner et al. | |
| 7,437,993 | B2 | 10/2008 | Kulpa | |
| 7,448,622 | B2 | 11/2008 | Kim | |
| 7,475,979 | B2 | 1/2009 | Miller et al. | |
| 2008/0239044 | A1 | 10/2008 | Yokota | |
| 2010/0128096 | A1 * | 5/2010 | Daniel et al. | 347/102 |

* cited by examiner

*Primary Examiner* — Daniel Petkovsek
(74) *Attorney, Agent, or Firm* — George M. Macdonald; Charles R. Malandra, Jr.; Steven J. Shapiro

(57) ABSTRACT

Printing systems including top registration plates and electromagnetic-curable inkjet print heads are described including methods for setting the intensity of the related electromagnetic sources. The printer includes a top registration plate that includes a plurality of registration plate print head openings, each opening adjacent to the registration plate. The transparent area is downstream of a UV light source and located above a media ski. In an alternative configuration, the top registration plate includes a transparent area that is adjacent to an opaque area of the registration plate. The transparent area is downstream of the UV light source and located above a media ski and below a light catch used to prevent the UV light from reaching the print heads in the printer.

16 Claims, 6 Drawing Sheets

SYSTEM AND METHOD FOR REGISTERING COLOR INK JET PRINTING IN A MAILING MACHINE

FIELD OF THE INVENTION

The present invention relates to printing systems and more particularly to printing systems and methods using electromagnetic curable inks such as ultraviolet curable ink jet inks in a top registering printer.

BACKGROUND OF THE INVENTION

Many types of document printers have been developed including home and office impact, laser, led and inkjet printers. Larger printers may be used for office workgroup applications or in industrial high speed printing applications. Similarly, many special purpose ink-jet printers have been developed such as dedicated envelope addressing printers including the ADDRESSRIGHT line of addressing printers and the DM SERIES of postage metering mailing machines (including the DM 500) available from Pitney Bowes Inc. of Stamford, Conn.

In a typical color inkjet page printer, the media is a sheet of 8.5×11 inch sheet of paper having a narrow range of acceptable thickness values such as about 0.003 to about 0.015 inch thickness. In such color inkjet page printers, the paper is typically registered downward on a registration plate and the paper thickness determines the distance to the print head. However, mailing machines including postage meters may be required to print on media in a wide range of thicknesses. For example, such mailing machines typically print on postcards and stuffed envelopes that may vary from approximately 0.005 to 0.625 inch or thicker material. Additionally, sealed envelopes may include captured air and thus may exhibit "puffiness" in that the air may shift in the envelope as the mailing machine handles the media.

In inkjet printing systems, there are several sources of printing error including ink dot placement error. The first type of dot placement error relates to the media distance from the print head. In order to maintain printing quality, it is important to control the distance from the print head nozzles to the media. When any given ink drop is fired from an inkjet nozzle, it takes a path that lies within a conical space having its apex at the nozzle and its base at the surface of the paper. Therefore, as the distance between the nozzle and the paper is increased, the diameter of the circular region at the base of the dot placement cone where the drop could actually land on the paper increases. When media thickness varies widely in a printing system having a static print head height, the system cannot use bottom registration and also maintain print quality. Accordingly, certain mailing machines including postage meter printers such as the DM 500 top register envelopes using a registration plate with a print head opening in order to control the distance from the print head to the media surface. For accurate ink-jet ink drop placement, the distance between the print head and the media is typically maintained at less than 0.020 inches. Moreover, typical mailing machine postage meter printers currently utilize water based inkjet inks. Solvent based and electromagnetic (such as approximately ultraviolet radiation (UV)) curable inks are sometimes used in larger or industrial printing applications. The various water based inkjet inks may include dye based or pigment based inks and may also include taggants such as red fluorescent taggants. However, UV inks are used in bottom registered printers in industrial applications. In such bottom registered UV ink printers, partial curing may be used in certain applications where it would not be possible in top registered printers.

In typical inkjet printers, there is a second source of dot placement error relating to nozzle to media distance. When the print head and the media are moved relative to one another in order to give the nozzle line access to all of the required areas on the paper, error based upon such movement is introduced. In a fixed head inkjet printer having a full printing width print head, only the media moves. In a shuttle head printer, at least the print head moves relative to the media and the media may also move relative to the print head. Since the time it takes for an ink drop to travel from the nozzle to the paper is dependent on the distance between the nozzle and the paper, variations in where the drop will land on the paper will occur with variations in the nozzle to paper distance.

When using several print heads, each with its own color, to produce a color print, the line of nozzles in each print head must be spaced some minimal distance from its neighbor that is governed by the width of the print heads. If the distance between the paper and the nozzles in a print head changes from that of the neighboring print heads, the placement of the different color dots will be different due to both types of dot placement error and thus will affect the resultant color image. Previously, top-registered mailing machine postage meter printers have generally utilized water based inkjet inks. Electromagnetic radiation curable (e.g., UV curable) inks have been used in certain other bottom registered printing systems including industrial sign printing applications.

Accordingly, there are several disadvantages of currently available printing systems and methods in general and of top-surface-registered printing systems in particular including the lack of suitable UV ink based top-registered printing systems.

SUMMARY

The illustrative embodiments of the present application describe printing systems and methods and more particularly describe top-registering electromagnetic-curing printing systems and related methods.

In one illustrative configuration, an electromagnetic ink cure printing system is provided. The printer includes a top registration plate that includes a plurality of registration plate print head openings. In another illustrative configuration, an alternative UV ink printing system is provided. The printer includes a top registration plate that includes a plurality of registration plate print head openings, each opening adjacent to a transparent area that is adjacent to an opaque area of the registration plate. The transparent area is downstream of the UV light source and located above a media ski and below a light catch used to prevent the UV light from reaching other print heads in the printer.

In another illustrative configuration, an alternative UV ink printing system is provided. The printer includes a top registration plate that includes a single registration plate print head opening, said opening adjacent to a transparent area that is adjacent to an opaque area of the registration plate. The transparent area is downstream of the UV light source and located above a media ski and below a light catch. The UV source is angled downstream in order to prevent the UV light from reaching the upstream print heads in the printer.

In yet another illustrative configuration, a method for curing electromagnetic-curable inks is described. The system first determines electromagnetic (EM) ink characteristics that may affect ink curing times. The system then determines media speed so that it can determine how long a particular area of printed media will be in the view of the curing source. The system then sets the intensity of the EM curing source in accordance with the media speed and/or ink characteristics and fires the EM source accordingly.

Several additional alternative configurations are also described below.

BRIEF DESCRIPTION OF THE DRAWINGS

The accompanying drawings illustrate several embodiments of the application, and together with the general description given above and the detailed description given below, serve to explain certain principles of the invention. As shown throughout the drawings, like reference numerals designate like or corresponding parts.

DETAILED DESCRIPTION

Figure 1:
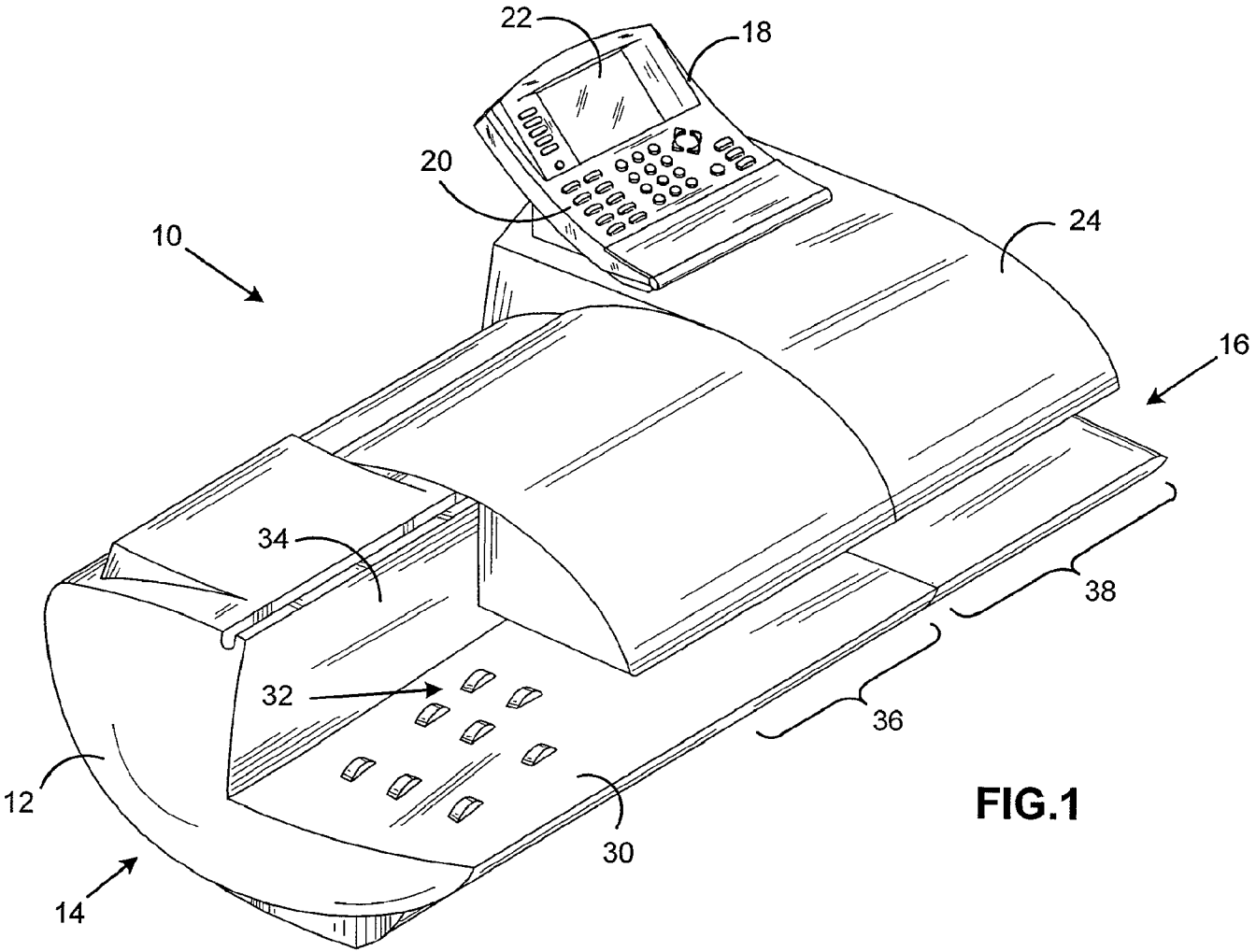
FIG. 1 is a schematic diagram of a mailing machine including an electromagnetic-curable ink jet postage meter printing system according to an illustrative embodiment of the present application.

The illustrative embodiments of the present application describe printing systems and methods and more particularly describe top-registering electromagnetic-curing printing systems and related methods. In general, relatively accurate dot placement is required when using multiple print heads to produce a color image. Print head to paper distance should generally be relatively closely controlled to achieve this accurate dot placement. Many available mailing machines include postage meter printing systems using water-based inkjet inks. However, electromagnetic-curable inks (such as UV curable inks) are also available for certain inkjet printing applications such as bottom registered industrial applications. In order to achieve the benefits of UV ink curing in a mailing machine, a suitable top-registered system was required. In one embodiment, UV sources are used to dry the ink printed at discrete color ink jet print heads in a color printing mailing machine so that the distance between the envelope and print head can be controlled using a registration plate and envelope ski system. This arrangement allows for relatively accurate placement of the different color dots with respect to each other. Significantly improved color print quality and avoidance of ink bleed due to water from an envelope flap stacked above it can be achieved in such a system.

A technique used in certain inkjet printing mailing machines to control the location of the surface of a puffy envelope with respect to the nozzles of a print head is to press the top surface of the envelope against a top registration surface using a spring loaded device called a ski. The downstream end of the ski is positioned as close to the upstream side of the print head nozzles as possible and approximately in line with the start of an opening in the registration plate that allows the ink drops to reach the envelope surface. In a single print head application such as a monochromatic printing mailing machine, there is only one top registration plate opening and only one media ski. This positioning prevents the ski from pushing or bowing any portion of the upper surface of a puffy envelope up through the opening in the registration plate used for printing. The resulting clamping action between the ski and the registration plate is similar to the embedded end of a cantilever beam.

The vertical deflection of the envelope is extremely small for a short distance downstream from the end of the ski. To prevent smearing of the printed image in a water-based ink inkjet system, the opening in the registration plate is continued downstream in the envelope transport direction to allow the ink a period of time to dry before the ski forces the printed portion of the media into the bottom of the downstream portion of the top registration plate. However, the length of the opening that allows for drying may be relatively long and as such, prevents the use of a series of similar arrangements in a series multiple print head system. For example, it prevents using the surface of the registration plate and a second ski in the same fashion as the first to control the envelope surface at the print head used to print the next color. Certain illustrative embodiments of the present application solve at least the problem by providing a top registration printing system that may be used with UV curing inks. UV curing inks allow for relatively quicker curing time and thus are suitable for use with registration plate opening that are relatively short and that can be used in a series of print head/curing source modules. A curing source may be positioned slightly downstream of each print head. Such an arrangement allows the image printed by the first print head to be pressed against the registration plate prior to the next print head without smearing the first image. This process is repeated with the successive print heads to produce an image that will also not smear as it exits the mailing machine. Also, since the inks are in a cured state, they would not be affected by any water that might be on the flap side of an envelope that was stacked on top of it at the exit of the mailing machine.

Mailing machines including monochromatic postage meter inkjet printers have been described including in commonly-owed U.S. Pat. No. 5,806,994, entitled Mailing Machine Having Ink Jet Printing and Maintenance System, issued Sep. 15, 1998 to Coffy, et al. and in commonly-owed U.S. Pat. No. 6,685,184 B2, entitled Transport Method and System for Controlling Timing of Mail Pieces Being Processed by a Mailing System, issued Feb. 3, 2004 to Tufecki, et al., both incorporated herein by reference in their entirety. In one illustrative configuration, an electromagnetic ink cure printing system is provided. The printer includes a top registration plate that includes a plurality of registration plate print head openings.

Referring to FIG. 1, a schematic diagram of a mailing machine 10 including an electromagnetic-curable ink jet postage meter printing system according to an illustrative embodiment of the present application is shown. The mailing machine 10 comprises a base unit, designated generally by the reference numeral 12, the base unit 12 includes a mail piece input end, designated generally by the reference numeral 14 and a mail piece output end, designated generally by the reference numeral 16. A control unit 18 is mounted on the base unit 12, and includes one or more input/output devices, such as, for example, a keyboard 20 and a display device 22. One or more cover members 24 are pivotally mounted on the base 12 so as to move from the closed position shown in FIG. 1 to an open position (not shown) so as to expose various operating components and parts for service and/or repair as needed.

The base unit 12 further includes a horizontal feed deck 30 which extends substantially from the input end 14 to the output end 16. A plurality of nudger rollers 32 are suitably mounted under the feed deck 30 and project upwardly through openings in the feed deck so that the periphery of the rollers 32 is slightly above the upper surface of the feed deck 30 and can exert a forward feeding force on a succession of mail pieces placed in the input end 14. A vertical wall 34 defines a mail piece stacking location from which the mail pieces are fed by the nudger rollers 32 along the feed deck 30 and into a transport subsystem that transports the media such as envelopes to be franked to the electromagnetic-curable inkjet printing subsystem (not shown) that is generally located under cover 24. In this illustrative example, mailing machine 10 comprises a modified version of the DM 500 mailing machine available from Pitney Bowes Inc. of Stamford Conn. The mailing machine 10 is modified to include a 4 color UV curable inkjet printing subsystem and associated control components.

Figure 2:
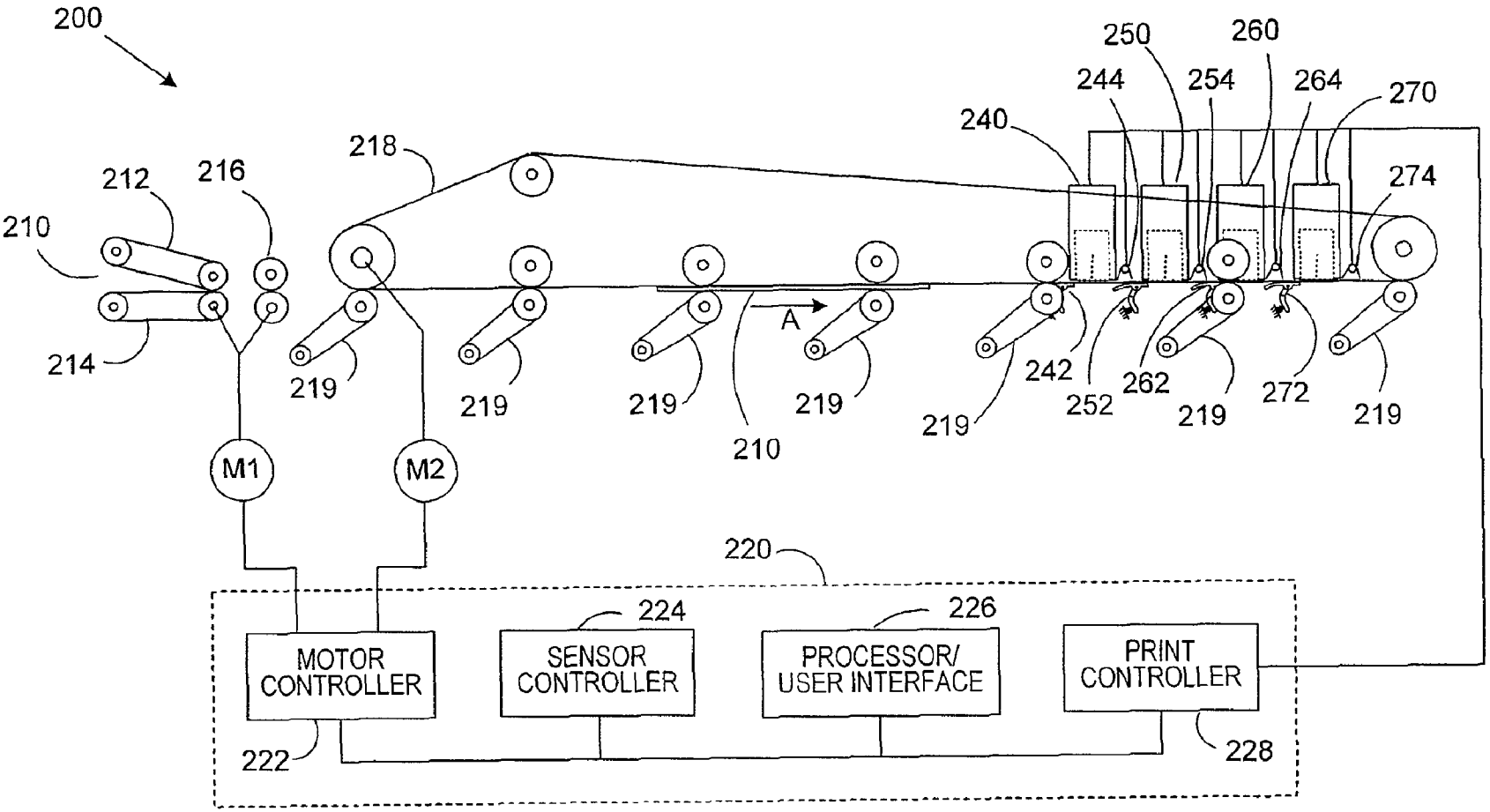
FIG. 2 is a partial schematic diagram of a controller, media transport subsystem and color electromagnetic-curable ink jet printing subsystem of the mailing machine of FIG. 1.

Referring to FIG. 2, a partial schematic diagram of the mailing machine of FIG. 1 including a printing subsystem 200 having a controller, media transport subsystem and color electromagnetic-curable ink jet printing subsystem is shown. The controller and transport subsystem configuration is illustrative and other suitable subsystem configurations may be substituted as appropriate. The mailing machine 10 includes a UV curable inkjet printing subsystem as described more fully herein.

The conveyor subsystem includes a singulator module 210 that receives a stack of media such as a stack of envelopes (not shown) including envelope 210, or other mail pieces such as postcards, folders and the like, and separates and feeds them serially in a path of travel as indicated by arrow A. The conveyor subsystem feeds the envelopes 210 in the path of travel A along a deck past the printer subsystem so that a postal indicia or other marking can be printed on each envelope 210. Together, the singulator module 210 and the conveyor module make up a transport subsystem for feeding the media in mailing machine 10. The singulator module 210 includes a feeder assembly 214 and a retard assembly 212 which work cooperatively to separate a stack of envelopes (not shown) and feed them one at a time to a pair of take-away rollers 216. The feeder assembly 214 and take-away rollers are driven by motor M1 using any suitable drive train (not shown).

The conveyor subsystem includes an endless belt subsystem 218 including a belt and pulleys (including a drive pulley driven by motor M2) mounted to any suitable structure (not shown) such as a frame. The drive pulley is operatively connected to motor M2 by any conventional means such as intermeshing gears (not shown) or a timing belt (not shown) and controlled by motor controller 222 in order to advance the envelope 210 along the path of travel A. The conveyor subsystem also includes a plurality of idler pulleys with normal rollers 219. The normal force rollers 219 work to bias the envelope 210 up against the deck including a top registration plate in a system known as top surface registration. In the area of the print subsystem, the registration plate has appropriate opening near the print heads as described further herein. The printer subsystem is a 4 color "CMYK" UV curable inkjet system and includes 4 print heads comprising a Cyan "C" print head 240, a magenta "M" print head 250, a Yellow "Y" print head 260 and a Black "K" print head 270. In this illustrative configuration, each print head is adjacent to a UV source such as a UV LED 244, 254, 264, 274 with each print head and UV source operatively connected to print controller 228.

The controller subsystem 220 includes motor controller 222, sensor controller 224, main processor and user interface 226 and the print controller 228 along with associated memory and peripheral components (not shown). The sensor controller 224 preferably controls media location detectors such as optical position detectors and other mailing machine sensors (not shown). Other modules of the mailing machine 10 have not been shown for the sake of clarity. The covers of mailing machine 10 comprise an opaque plastic such as grey, tan or blue plastic or other suitable material. The internal structural components comprise aluminum and can alternatively be made of steel or other suitable material. Similarly, the skis and registration plate are typically statically conductive and comprise aluminum and can alternatively be made of steel or other suitable material. In lower speed units, the skis and registration plate may comprise opaque plastic with UV blockers except as described herein for light catch inserts.

The UV curable inks used may include HP SCITEX UV Curable inkjet inks available from Hewlett Packard of Palo Alto Calif. or the TIJ UV curable inkjet inks available from ImTech of Corvallis, Oreg. The UV LEDs comprise model UV-1 WS-L2 1 Watt High Power UV LED and may alternatively comprise UV LED CURE-ALL LINERAR 100 LED Array available from UV Process Supply, Inc. of Chicago, Ill. or a CREE XLAMP 7090 UVV LED available from Cree, Inc. of Durham, N.C. The UV LEDs should be suitable for the range of UV curable inks contemplated in the application and may be required to output approximately 350 mJ/cm2 in the UV-B range for HP UV curable inks. The UV LEDs may be situated in a housing with appropriate mirrors, shutters and lenses.

Figure 3:
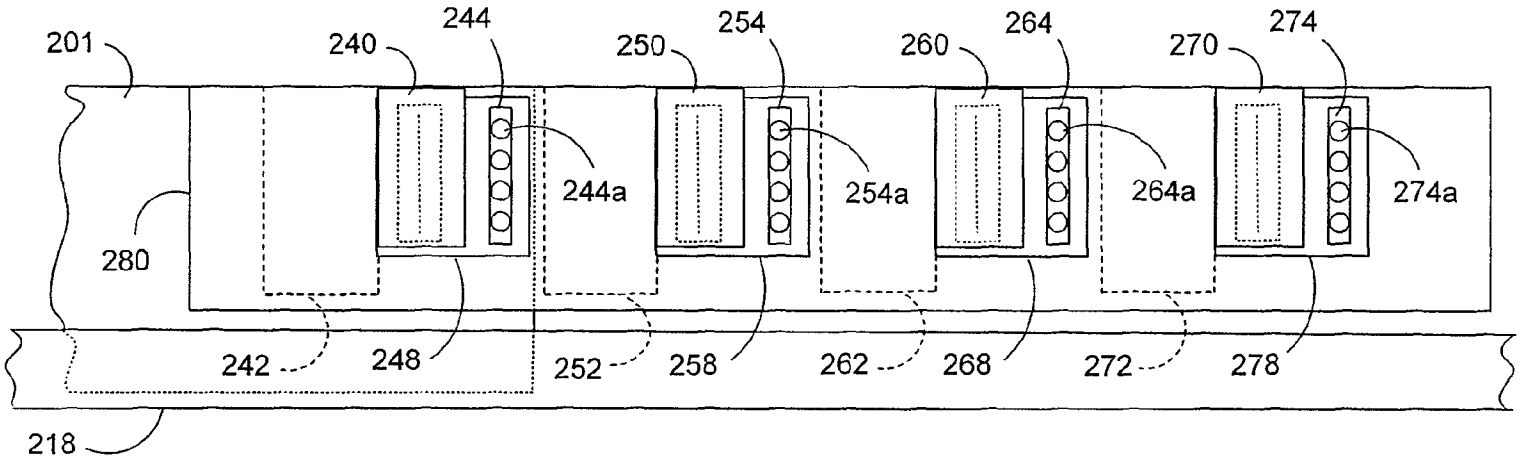
FIG. 3 is a top view partial schematic diagram of a portion of the media transport subsystem and color electromagnetic-curable ink jet printing subsystem of the mailing machine of FIG. 1.

Referring to FIG. 3, a top view partial schematic diagram of a portion of the media transport subsystem and color electromagnetic-curable ink jet printing subsystem of the mailing machine of FIG. 1 is shown. The top drive belt 218 operates in an endless loop to drive the envelope 201 through the printing subsystem. The registration plate 280 sits above a plurality of skis 242, 252, 262, 272. The registration plate has a plurality of relatively short in the media path direction) openings 248, 258, 268, 278 to allow the print heads to fire UV curable ink through the registration plate 280 down to the media (envelope) 210. Each of the print heads "C" 240, "M" 250, "Y" 260 and "K" 270 fire thorough the respective associated registration plate opening.

The electromagnetic curing source in this illustrative configuration comprises UV LEDs. As is known, UV LEDs may operate somewhat out of the pure UV band definition. UV LEDs 244, 254, 264, 274 may each include an array or ganged set of LEDs 244*a*, 254*a*, 264*a*, 274*a* in order to provide the required UV intensity to cure the UV inks used in the allotted time due to the media speed through the transport system. For example, the ganged UV LED's may be housed in a UV opaque housing that has a slot in the appropriate direction to direct UV radiation at the intended portion of the media. The associated controller is suitably configured to control the ganged LEDs and when providing a certain intensity may use all or less than all of the LEDs in the module.

Figure 4:
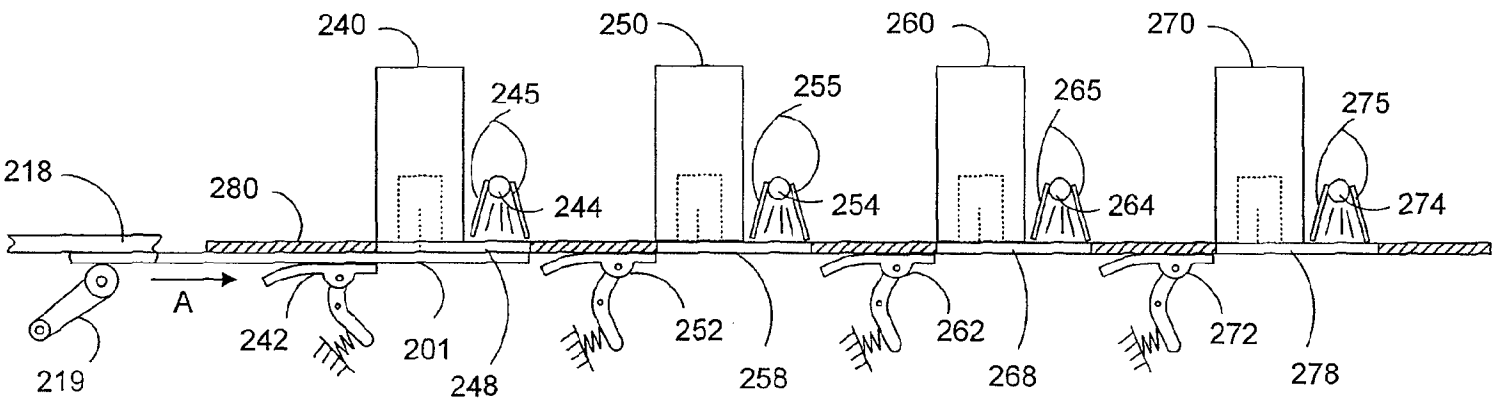
FIG. 4 is a side view partial schematic diagram of a portion of the media transport subsystem and color electromagnetic-curable ink jet printing subsystem of the mailing machine of FIG. 1.

Referring to FIG. 4, a side view partial schematic diagram of a portion of the media transport subsystem and color electromagnetic-curable ink jet printing subsystem of the mailing machine of FIG. 1 is shown. The top drive belt 218 operates in an endless loop in conjunction with idler rollers 219 to drive the envelope 201 through the printing subsystem. The registration plate 280 sits above a plurality of skis 242, 252, 262, 272. The registration plate has a plurality of relatively short in the media path direction) openings 248, 258, 268, 278 to allow the print heads to fire UV curable ink through the registration plate 280 down to the media (envelope) 210. Each of the print heads "C" 240, "M" 250, "Y" 260 and "K" 270 fire through the respective associated registration plate opening. The electromagnetic curing source in this illustrative configuration comprises UV LEDs. As is known, UV LEDs may operate somewhat out of the pure UV band definition. UV LEDs 244, 254, 264, 274 may each include a shield or focusing device 245, 255, 265, 275 to prevent UV radiation from contacting other portions of the mailing machine 10.

Figure 5:
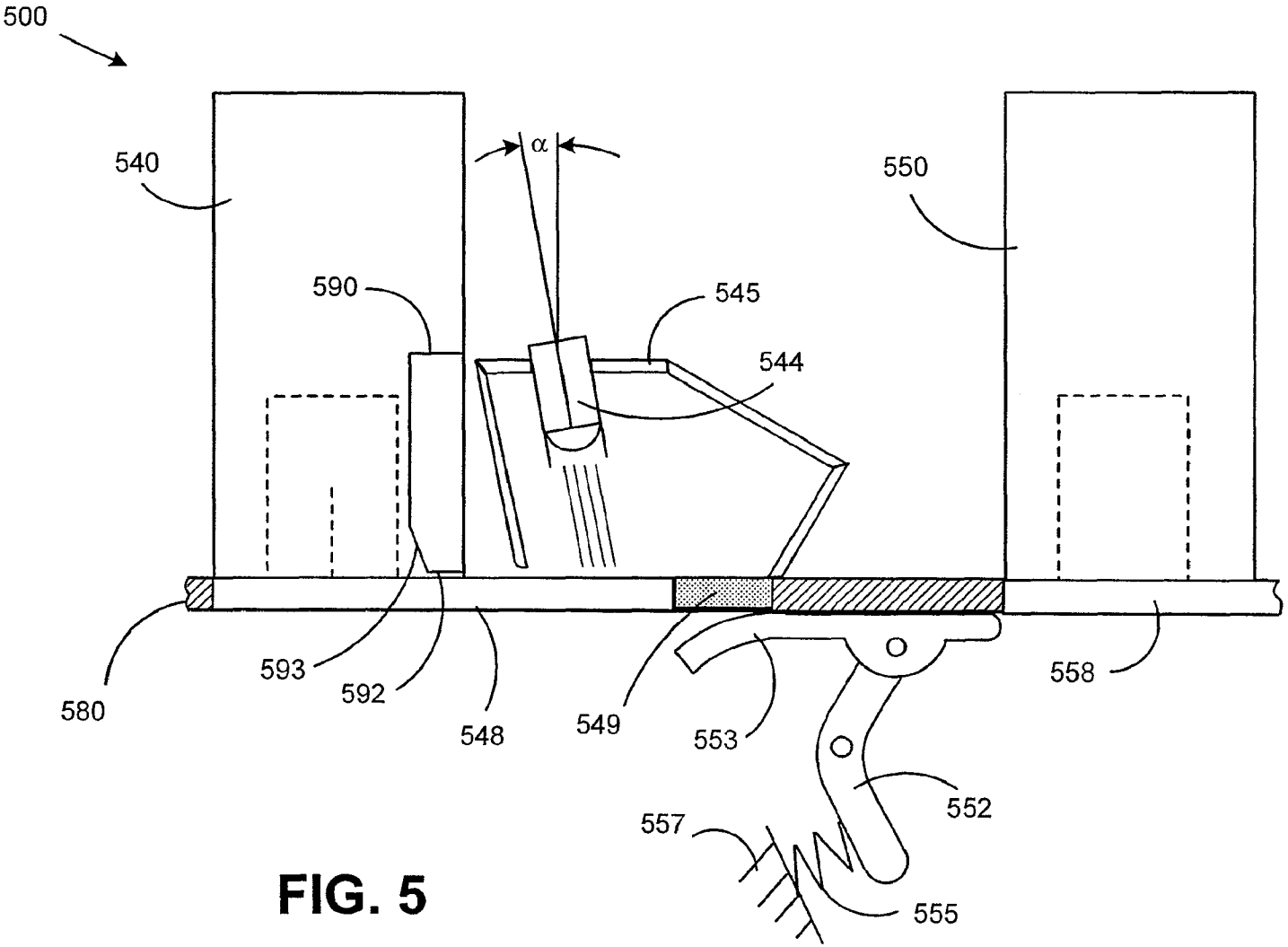
FIG. 5 is a side view partial schematic diagram of a portion of an alternative color electromagnetic-curable ink jet printing subsystem of a mailing machine according to another illustrative embodiment of the present application.

Referring to FIG. 5, a side view partial schematic diagram of a portion of an alternative color electromagnetic-curable ink jet printing subsystem 500 of a mailing machine according to another illustrative embodiment of the present application is shown. In this illustrative configuration, an alternative UV ink printing system is provided. The printer includes a top registration plate that includes a plurality of registration plate print head openings, each opening adjacent to a transparent area that is adjacent to an opaque area of the registration plate. The transparent area is downstream of the UV light source and located above a media ski and below a light catch used to prevent the UV light from reaching other print heads in the printer.

Here, the "C" print head 540 is above the top registration plate 580 and generally above registration plate opening 548. The ski 552 is described in more detail and includes the front contact portion of the ski 553 that ensures the media stays on a proper path and pivoting ski section 552 biased by spring 555 that is attached to mount 557. The UV lamp 544 is also described in more detail. It is aimed downstream and may include a lens or focusing device and a light catch assembly 545. The downstream "M" print head 550 is positioned above registration plate opening 558 and is desirable that the UV radiation from lamp 544 not reach the nozzles of print head 550 (or other print heads including 540). Shield 545 is angled as shown to provide a light catch using suitable material for absorbing the UV radiation. The light catch 545 is positioned adjacent to the registration plate. In that are of the registration plate adjacent to the downstream part of registration plate opening 548, a new UV transparent or somewhat transparent portion 549 is provided to operate in conjunction with the UV radiation catch 545.

UV transparent portion 549 preferably sits above the angled opening portion of the ski 553 where some UV reflection off the media may occur. The UV transparent portion 549 is preferable a suitable plastic such as Polymethylmethacrylate (PMMA) (also known as plexiglass) or Polystyrene (PS) (commonly used in CD Cases). Such materials are hard plastics that should wear well in the media contact application described herein. Furthermore, such materials should be substantially clear and free of UV blockers. (Some versions of these materials are opaque and often contain additives to block V, but would not be suitable in this application). Any diffraction angle is provided for in positioning of the UV light catch 545 and the angle alpha ($\alpha$) of the LED. In yet another alternative, the print heads such as "C" print head 540 also include a UV light catch 590. The UV light catch 590 includes a UV transparent or somewhat transparent section 592 and a shield portion 593 that must be suitable to shield the ink inside print head 540 from the UV radiation. Here, the angle alpha ($\alpha$) of the LED is preferably set to 20 degrees, but may be set to 0 degrees if not angle is desired or instead from a range of 5 degrees through 45 degrees is an angle is desirable. In an alternative, the angle alpha ($\alpha$) of the LED 544 may be adjusted based upon the properties of the UV-curable ink being used. Here, UV LED 544 includes a shield that directs the UV source in the direction that the LED is directed so that the UV beam is relatively narrow.

A bottom registered UV inkjet system is described in U.S. Patent Application Publication No. 2008/0239044 A1, published Oct. 2, 2008 by Yokota that is incorporated by reference herein in its entirety. The suitable ink and lamp combinations described there that are suitable for the purposed described herein may be used as an alternative in any of the applicable embodiments herein with adjusted lamp intensities to more fully cure each of the upstream colors before the media moves downstream so that the printed portion engages the next portion of the top registration plate.

Figure 6:
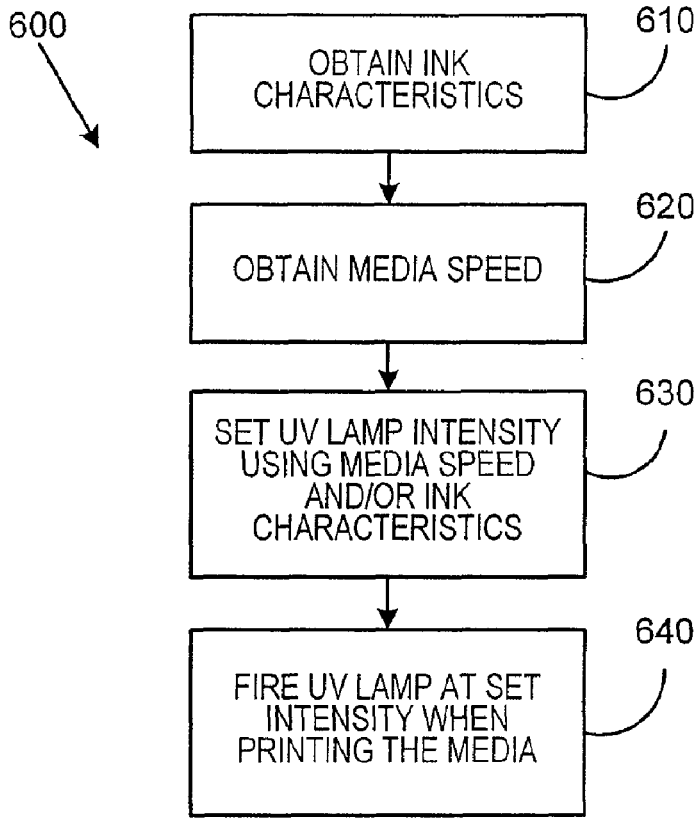
FIG. 6 is a flowchart showing an illustrative process for setting an electromagnetic-curing device intensity according to an embodiment of the present application.

Referring to FIG. 6, a flowchart showing an illustrative process for setting an electromagnetic-curing device intensity according to an embodiment of the present application is shown. In this configuration, a method for curing electromagnetic-curable inks is described. The system first determines electromagnetic (EM) ink characteristics that may affect ink curing times. The system then determines media speed so that it can determine how long a particular area of printed media will be in the view of the curing source. The system then sets the intensity of the EM curing source in accordance with the media speed and/or ink characteristics and fires the EM source accordingly. It may be advantageous to limit the amount of EM (such as UV) radiation output by the system to lessen the risk of nozzle clogging due to premature ink curing.

In step 610, the controller obtains ink characteristics for the electromagnetic curable inks. In one embodiment, the ink cartridge contains an RFID or other tag that identifies the type of ink to the system. In another alternative, an optical sensor may be used to detect identifying taggants placed in the ink as an identification code. In yet another embodiment a mailing machine operator may enter an ink identifier code. In step 620, the system obtains the media speed so that it can calculate the amount of time that the media will be in the view of the curing source such as the UV LEDs. The media speed may be provided by the sensor subsystem in relation to the media transport subsystem. In step 630, the printer controller sets the UV lamp intensity using the media speed data and/or the ink characteristic data. In step 640, the printer controller fires the UV lamp at the set intensity when printing the media in order to cure the UV-curable inkjet ink.

The intensity of the UV lamp may be set based upon the manufacturer, the manufacturer and the ink part number or other classification or even the color of the UV-curable ink. For example, the darker inks require longer curing time at a particular intensity or a higher intensity UV source. For example, if an approximately 350 mJ/cm2 in the UV-B range source is used for a yellow HP UV curable ink, then double that intensity may be advantageous for a black HP UV curable ink. Moreover, if a particular ink will be bathed by multiple downstream UV curing sources, then the first source may provide enough intensity to set the ink so that it will not smear and the downstream UV curing sources would then fully cure the ink.

Figure 7:
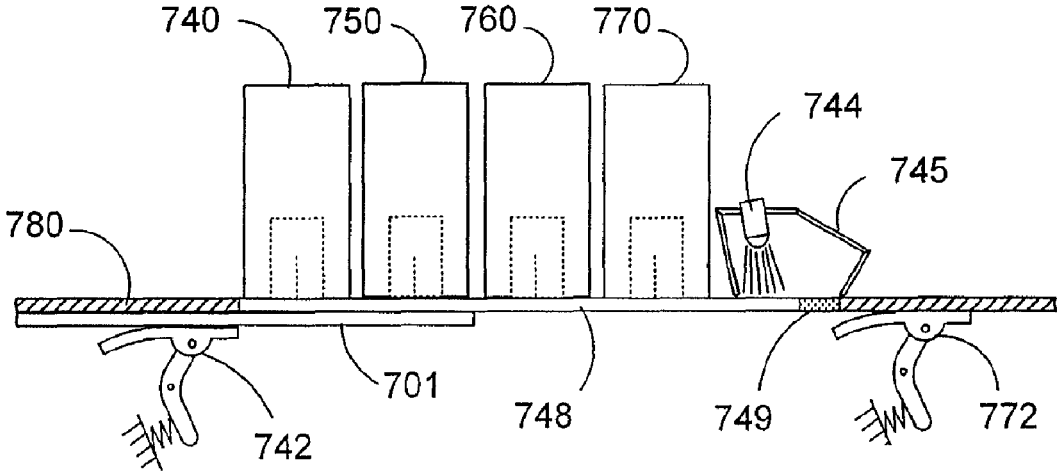
FIG. 7 is a side view partial schematic diagram of a portion of an alternative color electromagnetic-curable ink jet printing subsystem of a mailing machine according to another illustrative embodiment of the present application.

Referring to FIG. 7, a side view partial schematic diagram of a portion of an alternative color electromagnetic-curable ink jet printing subsystem 700 of a mailing machine according to another illustrative embodiment of the present application is shown. In this illustrative configuration, an alternative UV ink printing system is provided. The printer includes a top registration plate that includes a single registration plate print head opening, said opening adjacent to a transparent area that is adjacent to an opaque area of the registration plate. The transparent area is downstream of the UV light source and located above a media ski and below a light catch. The UV source is angled downstream in order to prevent the UV light from reaching the upstream print heads in the printer.

Here, the "CMYK" print heads 740, 750, 760, 770 are above the top registration plate 780 and generally above a single registration plate opening 748. This embodiment uses only two skis 742, 772 and only one UV lamp assembly 744 with only one UV light catch 745. Here, media 701 passes under all four print heads before passing under the UV source 744. The registration plate has one transparent or somewhat transparent section 749 downstream of the UV lamp 744. In an alternative embodiment applicable to any of the relevant embodiments herein, transparent section 749 extends upstream all the way under the UV lamp 744. UV transparent portion 749 is preferably a suitable plastic such as PMMA.

Figure 8:
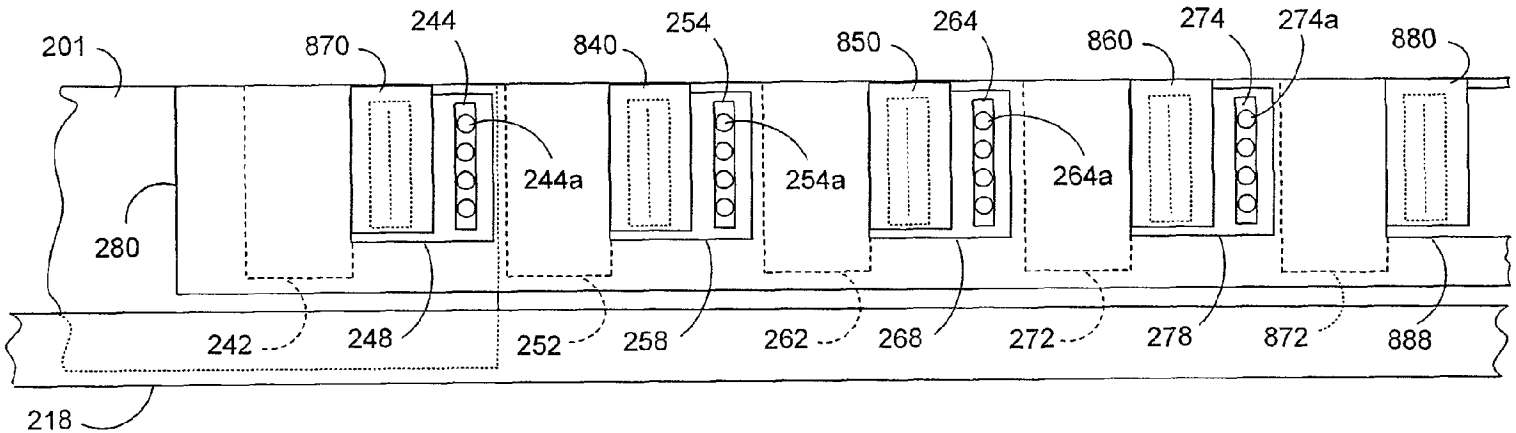
FIG. 8 is a top view partial schematic diagram of a portion of the media transport subsystem and color electromagnetic-curable ink jet printing subsystem of a mailing machine according to another illustrative embodiment of the present application.

Referring to FIG. 8, a top view partial schematic diagram of a portion of the media transport subsystem and color electromagnetic-curable ink jet printing subsystem of a mailing machine according to another illustrative embodiment of the present application is shown. The top drive belt 218 operates in an endless loop to drive the envelope 201 through the printing subsystem. The registration plate 280 sits above a plurality of skis 242, 252, 262, 272 and additionally ski 872. The registration plate has a plurality of relatively short in the media path direction) openings 248, 258, 268, 278 to allow the print heads to fire UV curable ink through the registration plate 280 down to the media (envelope) 210. In this alternative embodiment however, there is a final registration plate opening 888 that allows a non-UV curable print head 880 to fire air dried ink through the registration plate 280 down to the media (envelope) 210. The air dried ink comprises a red florescent ink used to provide facing tagging on envelopes that are to be mailed.

Here, each of the print heads is organized to be arranged from darkest to lightest ink color in the downstream direction. For example, the black ink print head "K" 270 is upstream and then followed by "C" 840, "M" 850, "Y" 860 and then the non-UV-curable ink print head 880. In this configuration, the black UV-curable ink that required the most UV curing radiation will be subjected to 4 UV curing sources and so on. UV-curing source 244 should be configured to at least set the black UV-curable ink being fired from print head 870. The electromagnetic curing source in this illustrative configuration also comprises UV LEDs. As is known, UV LEDs may operate somewhat out of the pure UV band definition. UV LEDs 244, 254, 264, 274 may each include an array or ganged set of LEDs 244*a*, 254*a*, 264*a*, 274*a* in order to provide the required UV intensity to cure the UV inks used in the allotted time due to the media speed through the transport system. For example, the ganged UV LED's may be housed in a UV opaque housing that has a slot in the appropriate direction to direct UV radiation at the intended portion of the media. The associated controller is suitably configured to control the ganged LEDs and when providing a certain intensity may use all or less than all of the LEDs in the module.

Figure 9:
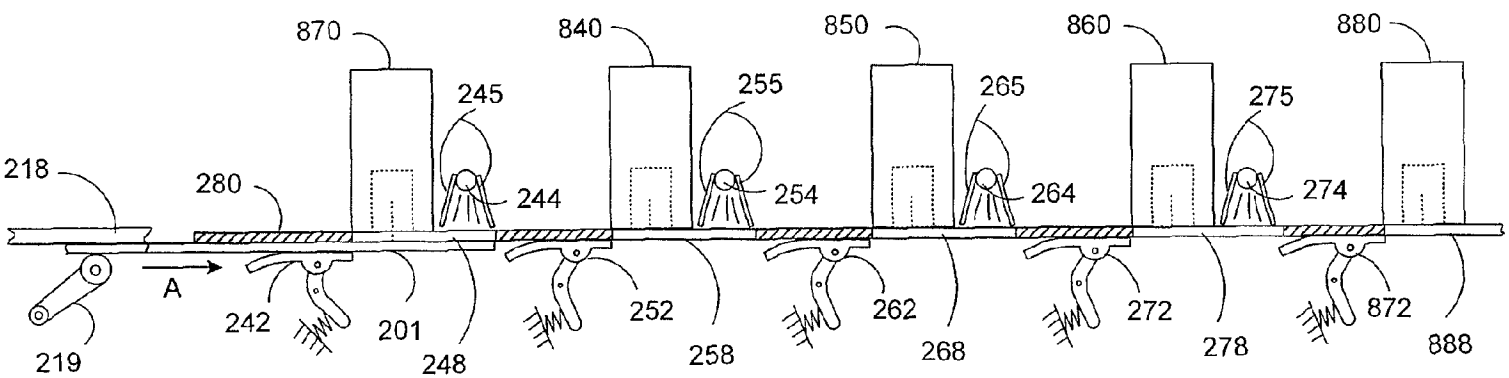
FIG. 9 is a side view partial schematic diagram of a portion of the media transport subsystem and color electromagnetic-curable ink jet printing subsystem of the mailing machine of FIG. 8.

Referring to FIG. 9, a side view partial schematic diagram of a portion of the media transport subsystem and color electromagnetic-curable ink jet printing subsystem of the mailing machine of FIG. 8 is shown. The top drive belt 218 operates in an endless loop in conjunction with idler rollers 219 to drive the envelope 201 through the printing subsystem. The registration plate 280 sits above a plurality of skis 242, 252, 262, 272 and additional ski 872. The registration plate has a plurality of relatively short in the media path direction) openings 248, 258, 268, 278 to allow the print heads to fire UV curable ink through the registration plate 280 down to the media (envelope) 210. Each of the UV-curable ink print heads "K" 870, "C" 840, "M" 850, and "Y" 860 fire through the respective associated registration plate opening. The non-UV-curable ink print head 880 fires through the longer registration plate opening 888. The electromagnetic curing source in this illustrative configuration comprises UV LEDs. As is known, UV LEDs may operate somewhat out of the pure UV band definition. UV LEDs 244, 254, 264, 274 may each include a shield or focusing device 245, 255, 265, 275 to prevent UV radiation from contacting other portions of the mailing machine 10. The opening 888 extends out in the downstream direction of the media path for a relatively long distance relative to the other openings in the registration plate. Opening 888 may also extend to the downstream end of the top registration plate.

In an alternative applicable to any relevant embodiment herein, different color orders may be designed using a tested absorbance spectrum for a particular series of UV-curable inks on paper. For example, for UV-curable inks from HP described above, for UV curing sources centered at 395 nm, the best order for the print heads would be black, yellow, magenta and then cyan.

In an alternative applicable to any relevant embodiment herein, different color schemes and therefore print head configured to fire ink other than the common "CMYK" colors may be utilized. In another alternative applicable to any relevant embodiment herein, multiple inkjet heads may be ganged in a single cartridge or multiple print head cartridges may be ganged in a carrier. In another alternative applicable to any relevant embodiment herein, one or more different color inkjet print heads may be utilized.

The processes described herein reside on an RENESAS H3 embedded controller board or an INTEL ATOM based embedded processor including associated memory and peripherals including communications peripherals for controlling the mailing machine. The processes are written in the C++ programming language or other suitable language to run on a LINUX embedded operating system or other appropriate operating system such as QNX or WINDOWS CE operating systems. Any or all of the computers described herein may as an alternative printing system also comprise a DELL personal computer, workstation, or mainframe and for servers may be resident in a single server or may be geographically distributed. The processes described herein may be also implemented in C++ on a MICROSOFT WINDOWS XP platform.

While several embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. A printer for printing electromagnetic-curable inks on media comprising:

a transport device for transporting media in a media path from an upstream position to a print location near a print head situated above the registration plate that is used for printing electromagnetic-curable inks;

said transport device including a top registration plate for top registering the media into the print position; and said top registration plate including at least one registration plate opening in proximity to the print head for allowing the print head to print the electromagnetic-curable ink on the media;

said transport device including at least one ski downstream of the print head and positioned below said top registration plate for top registering the media; and an electromagnetic source located at a downstream position in proximity to the print head and above the registration plate opening for curing the electromagnetic-curable ink.

2. The printer of claim 1, wherein:

the electromagnetic source comprises approximately ultraviolet radiation; and the top registration plate comprises a first section of material that is substantially opaque to UV radiation and a second section of material that is substantially transparent to UV radiation.

3. The printer of claim 2, further comprising:

a UV catch comprising UV absorbent material positioned downstream of the UV source adjacent to the second section of the top registration plate, a second UV catch integral to the print head, and wherein the second section of material comprises a plastic material substantially transparent to UV radiation.

4. The printer of claim 1, further comprising:

an electromagnetic catch downstream of the electromagnetic source.

5. The printer of claim 1, wherein:

the electromagnetic source is configured to radiate on an angle from perpendicular to the media path to irradiate the media downstream of its position.

6. The printer of claim 1, further comprising:

a non-electromagnetic-curable ink print head downstream of the print head.

7. The printer of claim 6, further comprising:

a relatively long registration plate opening in proximity to the non-electromagnetic-curable ink print head downstream of the print head and, wherein the at least one registration plate opening in proximity to the print head for allowing the print head to print the electromagnetic-curable ink on the media is relatively short compared to the relatively long registration plate opening.

8. The printer of claim 1, wherein:

the print head further comprises a plurality of print heads for printing a plurality of electromagnetic-curable inks each having an ink color; and the plurality of print heads are arranged upstream to downstream by the corresponding ink color from darkest to lightest.

9. A mailing machine including a printer for printing electromagnetic-curable inks on media comprising:

a transport device for transporting media in a media path from an upstream position to a print location near a print head situated above the registration plate that is used for printing electromagnetic-curable inks;

said transport device including a top registration plate for top registering the media into the print position; and said top registration plate including at least one registration plate opening in proximity to the print head for allowing the print head to print the electromagnetic-curable ink on the media;

said transport device including at least one ski downstream of the print head and positioned below said top registration plate for top registering the media; and an electromagnetic source located at a downstream position in proximity to the print head and above the registration plate opening for curing the electromagnetic-curable ink.

10. The mailing machine of claim 9, wherein:

the electromagnetic source comprises approximately ultraviolet radiation; and the top registration plate comprises a first section of material that is substantially opaque to UV radiation and a second section of material that is substantially transparent to UV radiation.

11. The mailing machine of claim 10, further comprising:

a UV catch downstream of the UV source adjacent to the second section of the top registration plate, a second UV catch integral to the print head, and wherein the second section of material comprises a plastic material substantially transparent to UV radiation.

12. The mailing machine of claim 9, further comprising:

an electromagnetic catch comprising UV absorbent material downstream of the electromagnetic source.

13. The mailing machine of claim 9, wherein:

the electromagnetic source is configured to radiate on an angle from perpendicular to the media path to irradiate the media downstream of its position.

14. The mailing machine of claim 9, wherein:

a non-electromagnetic-curable ink print head downstream of the print head.

15. The mailing machine of claim 14, wherein:

a relatively long registration plate opening in proximity to the non-electromagnetic-curable ink print head downstream of the print head and, wherein the at least one registration plate opening in proximity to the print head for allowing the print head to print the electromagnetic-curable ink on the media is relatively short compared to the relatively long registration plate opening.

16. The mailing machine of claim 9, wherein:

the print head further comprises a plurality of print heads for printing a plurality of electromagnetic-curable inks each having an ink color; and the plurality of print heads are arranged upstream to downstream by the corresponding ink color from darkest to lightest.

* * * * *